US008542115B2

(12) United States Patent
Karim et al.

(10) Patent No.: US 8,542,115 B2
(45) Date of Patent: Sep. 24, 2013

(54) ENVIRONMENTAL SENSOR WITH WEBSERVER AND EMAIL NOTIFICATION

(75) Inventors: Zia Karim, St. Charles, IL (US); David Doll, Sugar Grove, IL (US); Jonathan Michaels, Park Ridge, IL (US)

(73) Assignee: Honeywell International Inc., Morristown, NJ (US)

( * ) Notice: Subject to any disclaimer, the term of this patent is extended or adjusted under 35 U.S.C. 154(b) by 450 days.

(21) Appl. No.: 12/716,439

(22) Filed: Mar. 3, 2010

(65) Prior Publication Data

US 2011/0215923 A1 Sep. 8, 2011

(51) Int. Cl.
*G08B 21/00* (2006.01)

(52) U.S. Cl.
USPC .... 340/540; 340/531; 340/539.26; 340/691.6

(58) Field of Classification Search
USPC ..... 340/540, 539.1, 539.26, 584, 628, 340/506, 511, 531, 605, 691.6, 692
See application file for complete search history.

(56) References Cited

U.S. PATENT DOCUMENTS

| | | | | |
|---|---|---|---|---|
| 6,433,696 | B1 * | 8/2002 | Deiterman et al. | 340/632 |
| 6,583,720 | B1 | 6/2003 | Quigley | |
| 7,295,934 | B2 * | 11/2007 | Hairston | 702/45 |
| 7,336,168 | B2 * | 2/2008 | Kates | 340/539.18 |
| 2006/0238339 | A1 * | 10/2006 | Primm et al. | 340/540 |
| 2006/0273896 | A1 | 12/2006 | Kates | |
| 2009/0022362 | A1 * | 1/2009 | Gagvani et al. | 340/541 |

FOREIGN PATENT DOCUMENTS

| | | | |
|---|---|---|---|
| JP | 2006-031712 | A | 2/2006 |
| JP | 2007-179463 | A | 7/2007 |
| KR | 10-2008-0019273 | A | 3/2008 |
| KR | 10-2008-0020344 | A | 3/2008 |
| KR | 10-2008-0038756 | A | 5/2008 |
| KR | 10-2008-0055591 | A | 6/2008 |

OTHER PUBLICATIONS

PCT International Search Report, dated Oct. 12, 2011, corresponding to International Application No. PCT/US2011/027033.
EP Search Report for corresponding patent application EP 11751360.6 dated Jul. 3, 2013.

* cited by examiner

*Primary Examiner* — Thomas Mullen
(74) *Attorney, Agent, or Firm* — Husch Blackwell LLP

(57) ABSTRACT

A detector is described. The detector includes one or more environmental sensors that measures a predetermined environmental parameter, a processor that compares the measured parameter with a plurality of threshold values and detects that the measured parameter exceeds one of the plurality of threshold values and constructs a message to a person associated with the exceeded threshold value and an Internet protocol network interface that forwards the constructed message to the person.

19 Claims, 9 Drawing Sheets

800

NEXTVIEW - MICROSOFT INTERNET EXPLORER

FILE EDIT VIEW FAVORITES TOOLS HELP

BACK SEARCH FAVORITES

ADDRESS HTTP://199.63.213.249/HOME.HTML GO

NEXTVIEW

FAAST : FIRE ALARM ASPIRATION SENSING TECHNOLOGY

GENERAL | RELAYS & THRESHOLDS | NETWORK | LIVE VIEW | EVENTS

EVENTS VIEW

TOTAL EVENT COUNT: 730

FILTER GO

| S.NO. | EVENT TYPE | DATE & TIME |
|---|---|---|
| 711 | FILTER_COVER_OPEN | 06:11:2009 09:34:51 |
| 712 | UI_BUTTON_AUTOLOCK | 06:11:2009 09:34:56 |
| 713 | OP_MODE_TEST | 06:11:2009 09:34:55 |
| 714 | NETWORK_CONN_BROKEN | 06:11:2009 09:34:59 |
| 715 | CONFIGURATION_FAULT | 06:11:2009 09:35:04 |
| 716 | OP_MODE_ISOLATE | 07:03:2010 10:45:22 |
| 717 | OP_MODE_TEST | 07:03:2010 10:45:22 |
| 718 | FILTER_COVER_OPEN | 07:03:2010 10:45:22 |
| 719 | UI_BUTTON_AUTOLOCK | 07:03:2010 10:45:25 |
| 720 | OP_MODE_TEST | 07:03:2010 10:45:26 |
| 721 | NETWORK_CONN_BROKEN | 07:03:2010 10:45:30 |
| 722 | CONFIGURATION_FAULT | 07:03:2010 10:45:35 |
| 723 | OP_MODE_ISOLATE | 07:03:2010 10:50:45 |
| 724 | OP_MODE_TEST | 07:03:2010 10:50:46 |
| 725 | FILTER_COVER_OPEN | 07:03:2010 10:50:46 |
| 726 | UI_BUTTON_AUTOLOCK | 07:03:2010 10:50:49 |
| 727 | OP_MODE_TEST | 07:03:2010 10:50:49 |
| 728 | NETWORK_CONN_BROKEN | 07:03:2010 10:50:53 |
| 729 | CONFIGURATION_FAULT | 07:03:2010 10:50:58 |
| 730 | UNDEFINED | 01:01:1970 12:00:00 |

<< < > >>

INTERNET

*FIG. 7*

MESSAGE FROM COMPANY NAME DETECTOR NUM 6

◯ DETECTOR6@COMPANY.COM

TO: RECIPIENT1@COMPANY.COM 1004

---

COMPANY NAME
CITY, STATE
SWITCHING ROOM
DETECTOR NUM 6 HAS INITIATED AN ALERT 1002
<HTTP: //158.100.34.45> DETECTOR WEB SERVER 1006

*FIG. 9*

ENVIRONMENTAL SENSOR WITH WEBSERVER AND EMAIL NOTIFICATION

FIELD OF THE INVENTION

The field of the invention relates to environmental sensors and more particular to alarm sensors for buildings.

BACKGROUND OF THE INVENTION

Environmental sensors, such as fire alarms, are generally known. Such devices are typically constructed to detect heat or products of combustion and are often used to provide an early warning of fire in buildings or homes.

While such sensors can be used as stand-alone devices, fire alarms sensors are often connected to a local control panel that monitors the status of the individual sensors. Upon detecting a fire through one of the sensors, the control panel may activate a local audible alarm to alert human occupants of the detected fire.

In addition to activating a local audible alarm, the control panel may send an alarm signal to a central monitoring station. Upon receiving the alarm signal from the local control panel, the central monitoring station may alert the police or local fire department.

Because of the risks associated with fire, central monitoring stations often seek to mitigate the effects of fire alarm reports. When an indicator of fire is received, the central monitoring station will often attempt to contact an occupant within the protected facility in order to confirm the presence of a fire. If a local occupant cannot be contacted, the central station may dispatch security personnel to investigate the status of a facility. However, even this strategy may not work for small fires or for fires deep within a structure. Accordingly, a need exists for more flexible means for detecting and reporting the status of fire detectors.

BRIEF DESCRIPTION OF THE DRAWINGS

FIG. 7 depicts an event screen that may be used by the system of FIG. 1;

FIG. 9 depicts an Internet message delivered by the system of FIG. 1.

DETAILED DESCRIPTION OF AN ILLUSTRATED EMBODIMENT OF THE INVENTION

Figure 1:
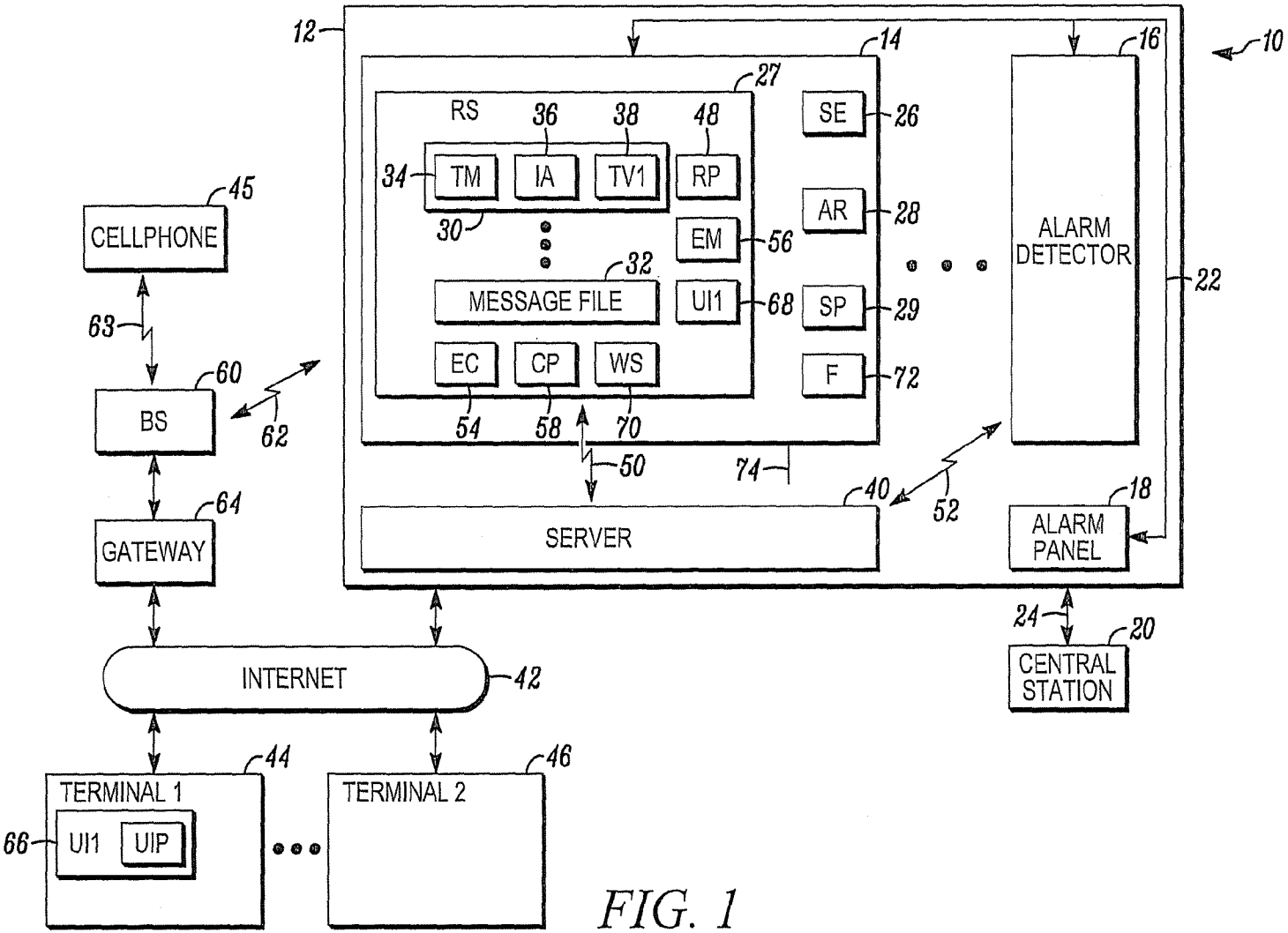
FIG. 1 depicts a fire alarm detection system in accordance with an illustrated embodiment of the invention.

FIG. 1 depicts a fire alarm system 10 shown generally in accordance with an illustrated embodiment of the invention. The alarm system 10 may include a number of environmental condition detectors (e.g., fire, heat, smoke, carbon monoxide, ionization, particulate etc.) 14, 16 located within and otherwise used to protect an area 12 against fires. While only two detectors 14, 16 are shown in FIG. 1, any number of detectors 14, 16 and/or sensors may be used and distributed throughout the area 12 depending upon the size of the area 12.

Also located within the protected area 12 may be a local alarm panel 18. The local alarm panel 18 and sensors 14, 16 may be interconnected via a wired or wireless network 22. The local alarm panel 18 in turn may be connected to a central monitoring panel 20 via a wired or wireless network 24.

The local alarm panel 18 and central monitoring station 20 may operate conventionally. During normal operation, the local alarm panel 18 may monitor the sensors 14, 16 for indication of fire. Upon detecting a signal indicating a fire from one of the sensors 14, 16, the local alarm panel 18 may activate a local audible alarm to alert any person located within the area 12 to the fire. The local alarm panel 18 may also send an alarm message to the central monitoring station 20.

Each of the alarm detectors 14, 16 includes a sensor element 26 and alarm reporting processor 28. The sensor element 26 and reporting processor 28 are conventional. The processor 28 monitors an output of the sensor element 26 and reports an alarm to the local alarm panel 18 upon detection of a fire.

At least some or all of the alarm sensors 14, 16 may also include an auxiliary reporting system 27 that reports the status of the alarm detectors 14, 16 independent of any process associated with the alarm panel 18 and central monitoring station 20. Included within the reporting system 27 of each of the sensors 14, 16 is a plurality of report message files 30, 32. Each of the report message files 30, 32 include a text message 34, an address (e.g., an Internet address) 36 and a threshold value 38. The threshold value 38 controls the sending of the text message to the Internet address 36 associated with each of the files 30, 32.

Each of the report message files 30, 32 is associated with a predetermined human user through a terminal (e.g., a cellular telephone, a personal digital assistant (PDA), a tablet PC, a personal computer, etc.) 44, 46. A reporting processor 48 within the detector 14, 16 continuously compares each threshold 38 with a sensed parameter (value) from the sensor element 26. When the sensor element value exceeds a threshold 38, the reporting processor 48 sends the reporting message to the corresponding user 44, 46.

The sensors 14, 16 may be coupled to the Internet 42 using any of a number of different mechanisms. For example, the sensors 14, 16 may be connected to the Internet 42 through a local area network (LAN) that may include a server 40. The sensors 14, 16 may be connected to the server 40 via one or more Ethernet connections 50, 52. In this case, the sensors 14, 16 may each be provided with a RJ45 receptacle for connection to the Ethernet via cables serving as connections 50, 52. Alternatively, the connections 50, 52 may be wireless.

During operation, the reporting processor 48 may continuously monitor the sensor element 26. In each case, the reporting processor 48 may retrieve values of the sensing element 26 in real time and compare the retrieved values with each of the threshold values 38. Upon determining or otherwise detecting that the retrieved value exceeds a threshold 38, the reporting processor 48 may retrieve the associated Internet address 36 and text message 34 in preparation for forwarding the message to a user 44, 46. The reporting processor 48 operating in conjunction with an Ethernet controller 54 may incorporate the Internet address 36 and text message 34 into an e-mail message 56 and send the message 56 to a user 44, 46 through the Internet 42. Under other embodiments, the message 56 may be sent and displayed as an Internet blog posting or other status update.

Alternatively, the sensors 14, 16 may each be provided with a cellular transceiver 58. In this case, the reporting processor 28 may incorporate the text message 34 into a chat or e-mail message and forward the message 56 to the cellular transceiver 58. In response, the cellular transceiver 58 may transmit the message to a local base station 60 of the cellular system. The base station 60 may receive the message 56 through a granted channel 62 and forward the message to the user 44, 46 through the Internet 42 and gateway 64.

Moreover, the base station 60 may deliver the message 56 to a local user through a cellphone 45. In this case, the base station 60 may forward the message to the cellphone 45 through a control channel using an appropriate signaling format (e.g., SS7, SMS, etc.).

Set up of the sensors 14, 16 may be accomplished under any of a number of different scenarios. Under one scenario, a user interface (e.g., an Internet Protocol network interface) between terminals 44, 46 and sensors 14, 16 may be provided for set up and control of the sensors 14, 16. In this regard, a first portion 66 of the user interface is provided within the user terminals 44, 46 and a corresponding, second portion 68 may be provided within the sensor 14, 16. A user of the user terminal 44, 46 may activate the first portion 66 of the user interface to monitor a status of each of the sensors 14, 16. Once activated, the first portion 66 functions to automatically set up a secure sockets layer (SSL) connection with the second portion 68.

Figure 2:
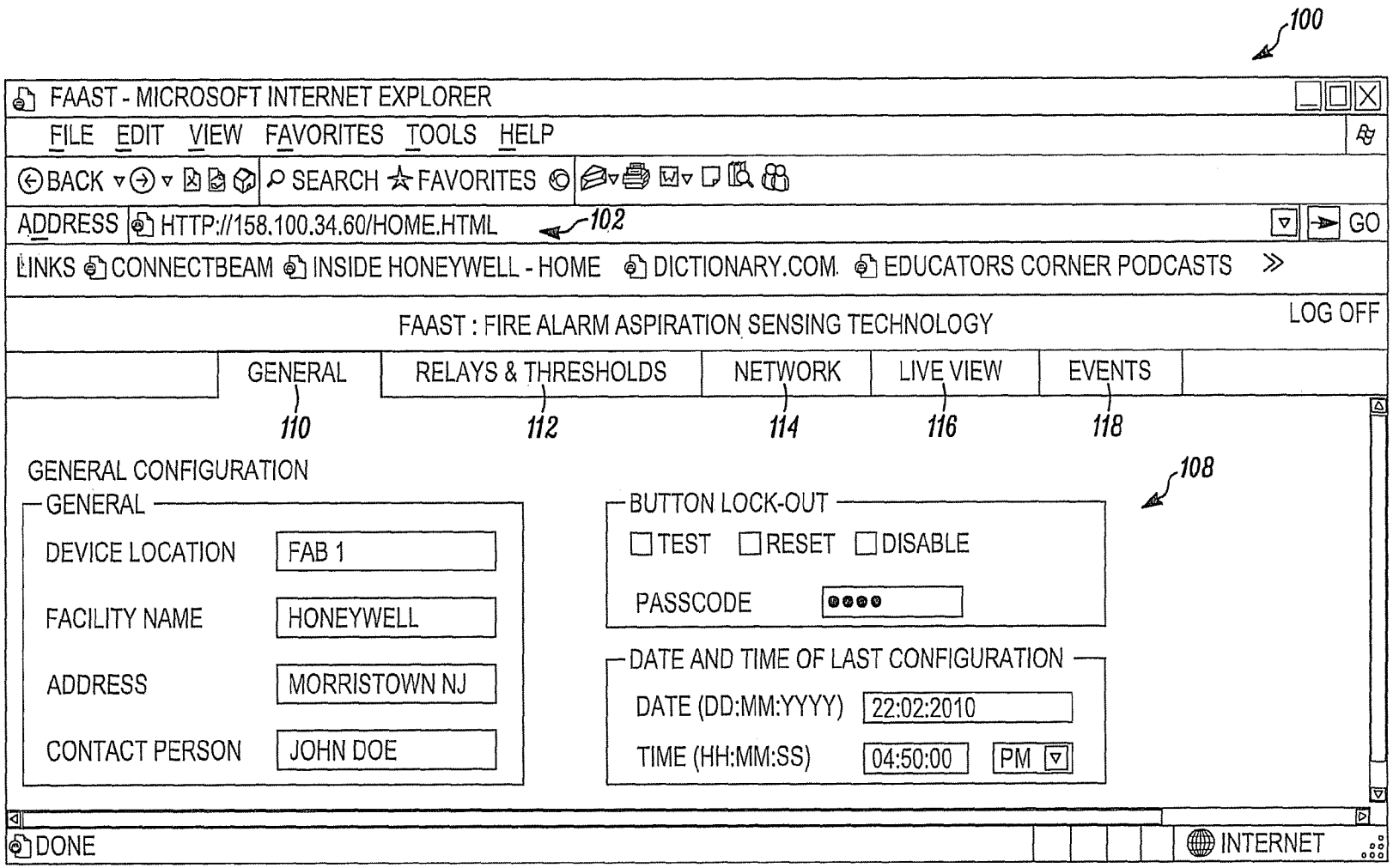
FIG. 2 depicts a sign-in and menu screen that may be used by the system of FIG. 1.

FIG. 2 is a sign-in and menu screen 100 that may be displayed through the user interface 66 on a display of a terminal 44, 46 upon completion of the connection. Shown at a top of the screen 100 may be an IP address 102 of the sensor 14, 16.

Also shown on the screen 100 is a menu 108 of operation and control tools available through the screen 100. Included within the menu 108 may be a "GENERAL" configuration tool 110, a "RELAYS AND THRESHOLDS" tool 112, a "NETWORK" tool 114, a "LIVE VIEW" tool 116 and an "EVENTS" tool 118.

Figure 3:
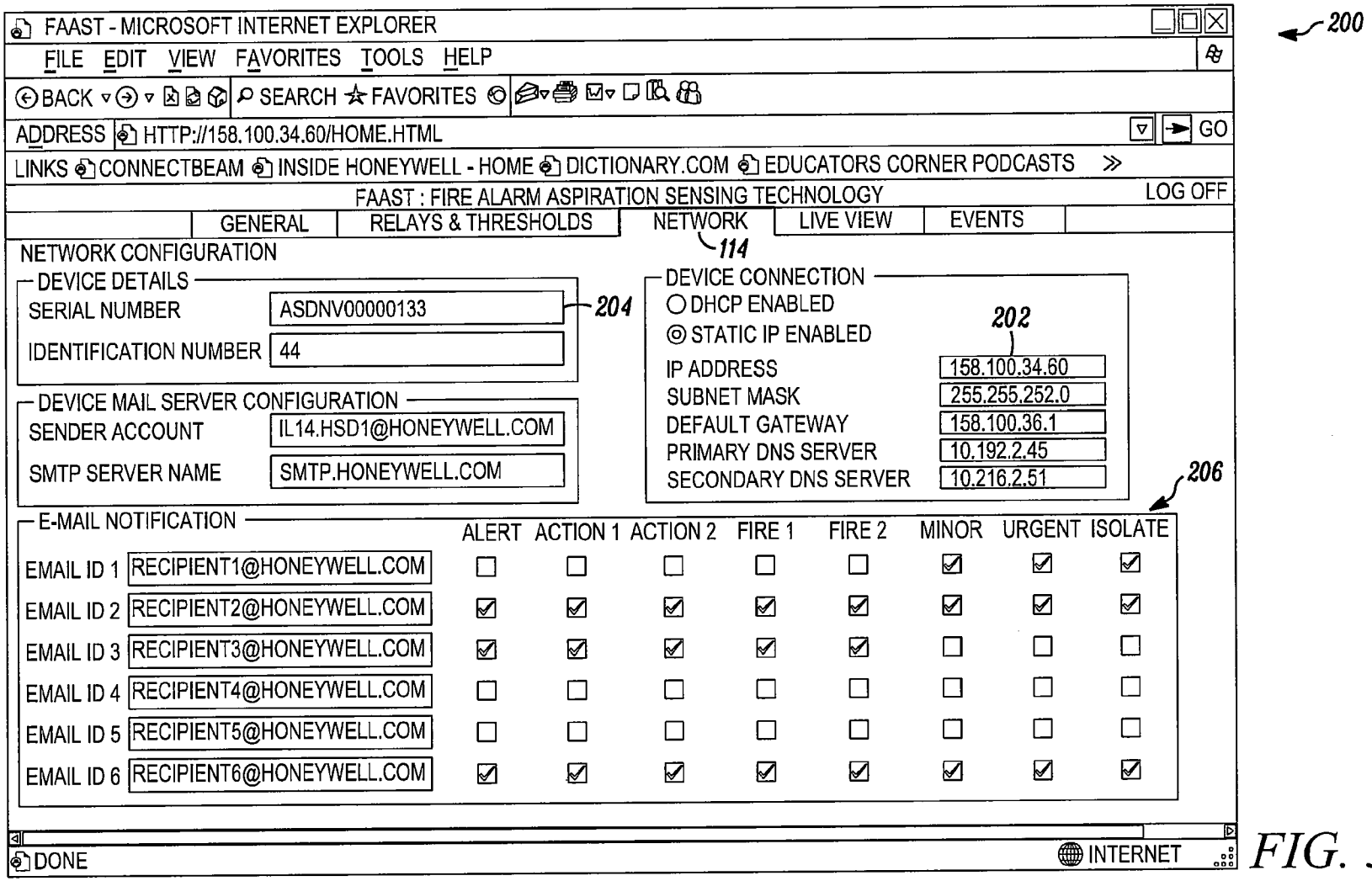
FIG. 3 depicts a network summary control screen that may be used by the system of FIG. 1.

If the user should activate the NETWORK tool 114, then the user is presented with the network summary screen 200 of FIG. 3. Shown within the network screen 200 may be an IP address 202 of the sensor 14, 16 as well as the device serial number 204. Also shown on the screen 200 is a summary list of report messages (six shown in the list 206 of FIG. 3). The Internet addresses 36 of the six messages are shown adjacent the respective Email IDs 1-6.

Similarly, the text messages 34 of the report message files 30, 32 are depicted, in part, by the respective column headers in the list 206. As shown, the text messages 34 are divided into five types. The five types are: 1) Alert, 2) Action 1, 3) Action 2, 4) Fire 1 and 5) Fire 2. An urgent notification or indication of a minor event can also be added to the text message 34 by checking the appropriate box. The threshold level 38 that triggers the sending of each reporting message is indicated by a check mark under the eight column headers. The Isolate column may be assumed to have a threshold indicative of a trouble condition or that the sensor 14, 16 has been deactivated.

If the user should wish to alter the destination of one or more of the messages 30, 32, then the user may activate the NETWORK tool softkey 114 of FIG. 3. In response, the user is presented with the network modification window 300 of FIG. 4. Within the network modification window 300, the user can modify the IP address of the sensor 14, 16 and/or the destination IP address 36 of the reporting messages. The user is also able to select among a number of different thresholds 38 that trigger sending of the messages 30, 32.

For example, if the user should wish to add a new message, then the user may simply enter an IP address 36 into one of the windows 302, 304. The user may select a threshold level 38 for sending a message by adding a check mark to one or more of the interactive boxes.

Figure 4:
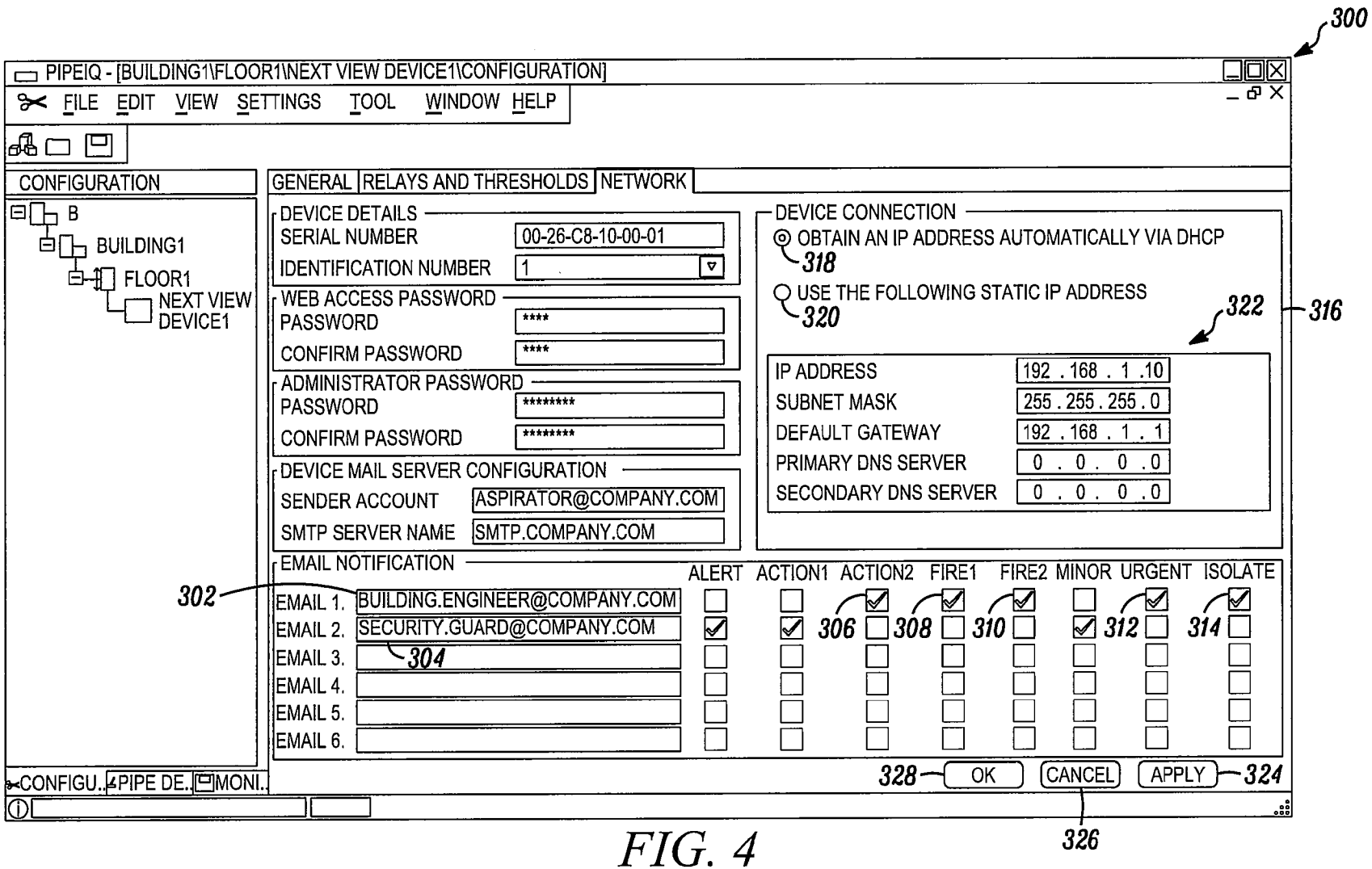
FIG. 4 depicts a message addressing control screen that may be used by the system of FIG. 3.

In the example of FIG. 4, the user has defined five different messages that will be sent to the e-mail address entered into box 302. In each case, a message will be sent to the address in box 302 when the measured value of the element 26 exceeds the threshold associated with each of the boxes 306, 308, 310, 312, 314.

Similarly, the user can alter an IP address of the sensor 14, 16 via the addressing box 316. For example, the user can select automatic addressing of the sensor 14, 16 via dynamic host configuration protocol (DHCP) by checking a first box 318. Alternatively, the user can enter a static IP address for the sensor 14, 16 by activating a second box 320 and entering an IP address via the box 322.

The user can accept the changes entered through the window 300 by activating the APPLY softkey 324 or the user may cancel by activating the CANCEL softkey 326. If the user activates the APPLY softkey 324, the changes are sent through the SSL channel and entered into the appropriate memory locations of the sensor 14, 16.

Figure 5:
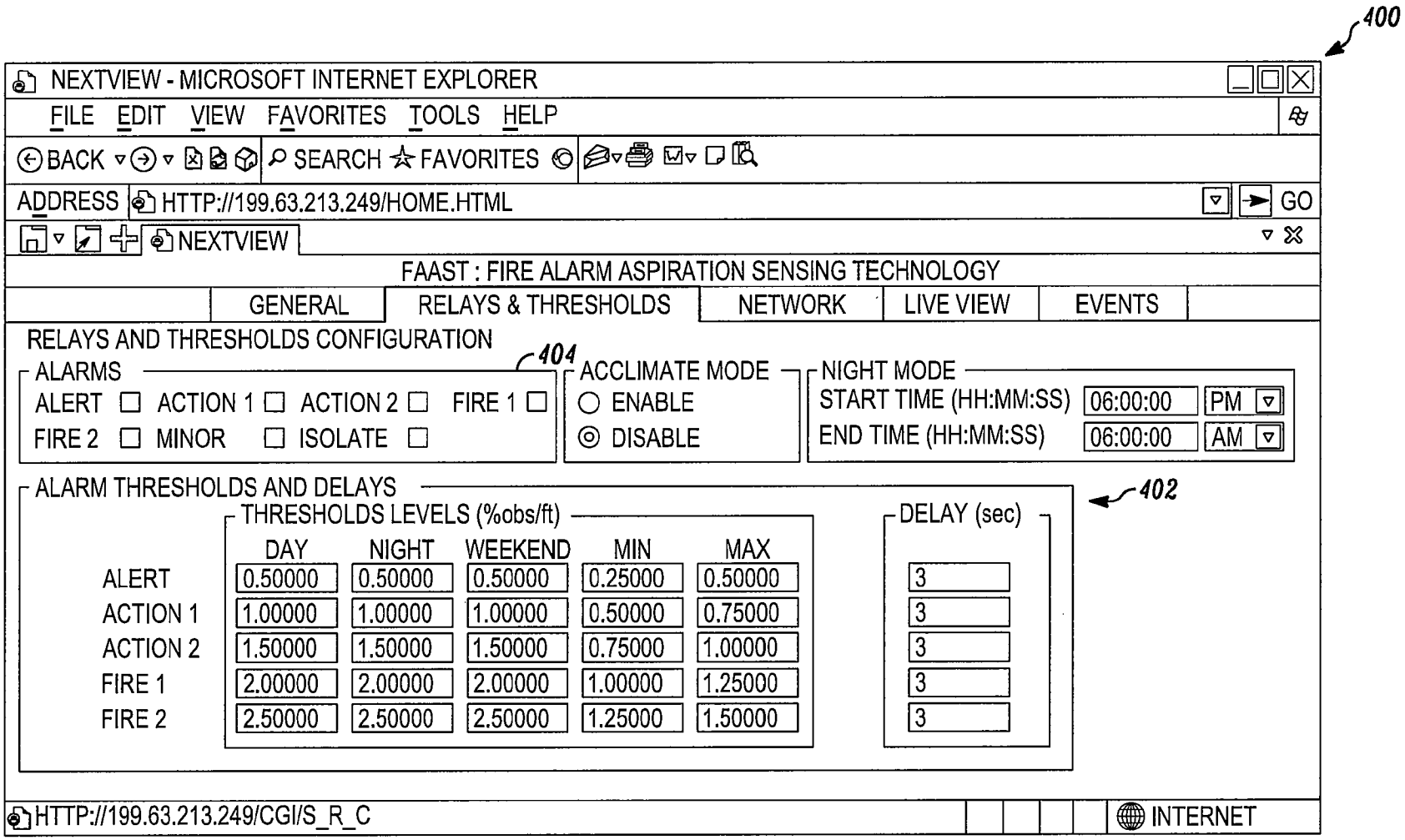
FIG. 5 depicts a threshold summary screen that may be used by the system of FIG. 1.

Once finished making network changes, the user may activate the OK softkey 328 one or more times and be taken back to the menu 108. From the menu 108, the user may activate the RELAYS & THRESHOLDS tool 112 and be taken to the threshold summary screen 400 of FIG. 5.

The threshold summary screen 400 contains a first window 402 that shows threshold values 38 associated with each text message 34. The examples of FIG. 5 may be used for a particulate detection system 10 that detects products of combustion and where the threshold values are depicted in units of percent obscuration per foot (% obs/ft). The summary screen 400 shows that the threshold values may be designated according to time of day (e.g., day, night weekend, etc.).

The threshold summary screen 400 may also contain a window 404 that indicates which conditions are also used to send an alarm signal to the alarm panel 18.

Figure 6:
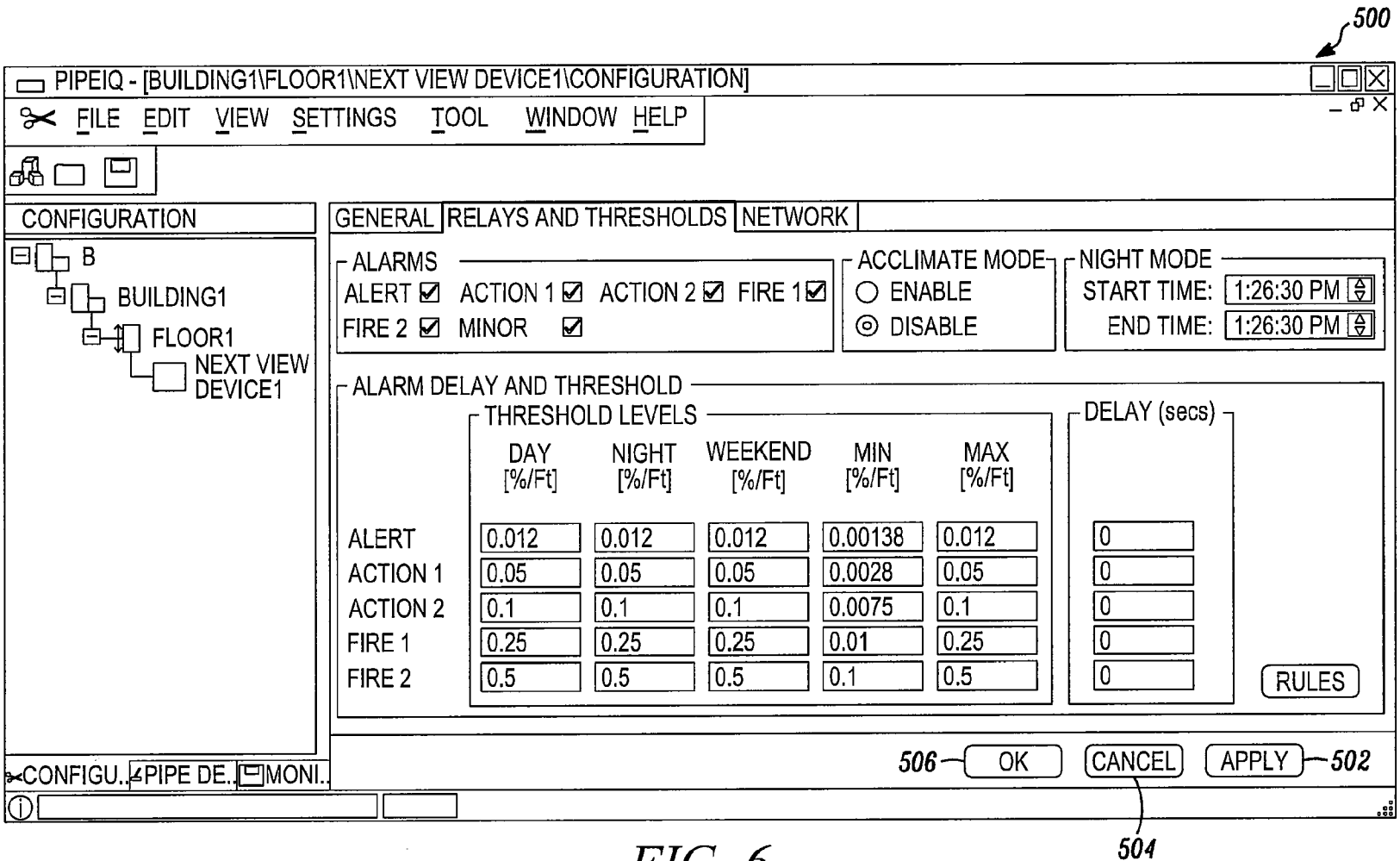
FIG. 6 depicts a threshold change control screen that may be used by the system of FIG. 1.

If the user should desire to change one or more of the threshold values, then the user may activate the RELAYS & THRESHOLDS softkey and be taken to the screen 500 of FIG. 6. Once obtaining access to the screen 500, the user can enter new threshold values 38 or alter existing thresholds by entering the appropriate value into the appropriate interactive text box. The user can also enter a time delay for which the reading must remain above the entered threshold before action would be taken. The user can also add or alter minimum or maximum values associated with each text message to define trouble conditions that would trigger an Isolate notification.

Similarly, the screen 500 allows the user to define the thresholds that are to be sent to the alarm panel 18. In this case, each level of Alert, Action 1, Action 2, Fire 1, Fire 2 and Minor have been checked.

Once the user has made whatever changes are necessary to the threshold values 38, the user may activate the APPLY softkey 502 or CANCEL softkey 504. In response, the interface 66 sends the changes to the corresponding interface 68 where the changes are implemented within the sensor 14, 16. To exit the RELAYS & THRESHOLDS tool, the user may again activate the OK softkey 506 and return to the operations menu 108.

Within the operations menu 108, the user may select the EVENTS tool 118 and be presented with the screen 800 of FIG. 7. Screen 800 shows a list of events reported a sensor 14, 16 over some time period. The user may scroll through the events using a set of scrolling control keys at the bottom of the screen 800.

Figure 8:
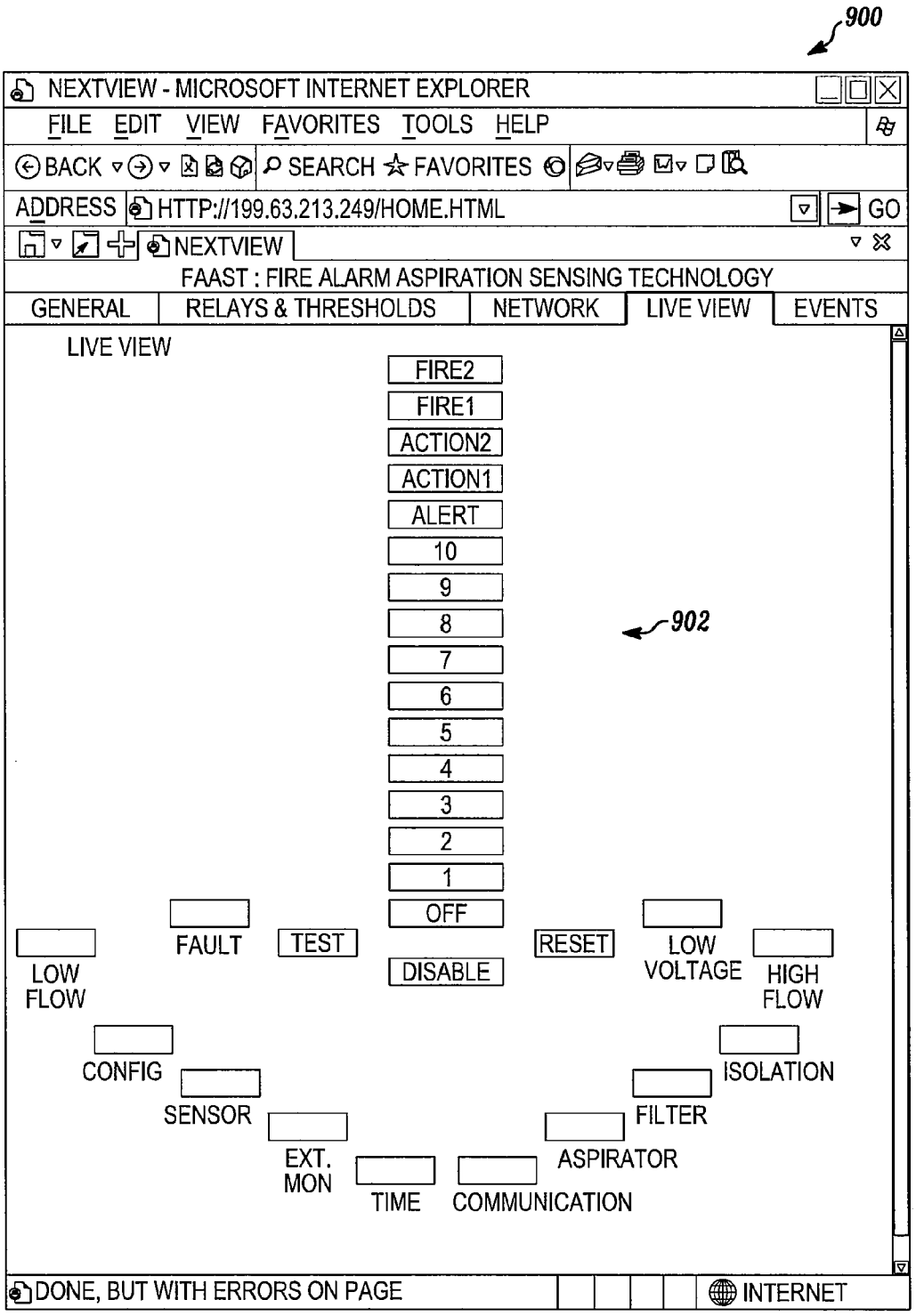
FIG. 8 depicts a live event screen that may be used by the system of FIG. 1.

The user may also select the LIVE VIEW tool 116. The LIVE VIEW tool 116 operates in conjunction with a website 70 within the sensor 14, 16 to provide the screen 900 of FIG. 8. In this case, the website 70 continuously monitors the measuring element 26 and provides real time indications of the measured value provided by the element 26 and as indicated by activated portions of the bar graph 902 labeled 1-10 in FIG. 8. In this case, if the element 26 is providing a value of zero then none of the boxes 1-10 would be activated, except for an OFF segment. If the element 26 is reading 100% then all ten boxes would be activated.

Similarly, the screen 900 provides an indication of the operation of the sensor 14, 16 relative to the threshold values. For example, if the read value from the sensing element 26 were above the ALERT threshold, then the ALERT segment of screen 900 would be activated. Similarly, if the sensing element 26 were above the respective threshold values for Action 1, Action 2, Fire 1, Fire 2, then those segments would be activated.

The live view of the screen 900 also allows the user to enter control commands such as RESET, DISABLE and TEST. RESET in this case allows the user to reset any alarm conditions detected by the sensor 14, 16. TEST allows the user to test features of the sensor 14, 16 by simulating conditions such as exceeding identified thresholds and verifying the sending of reporting messages 30, 32. DISABLE allows the user to take the sensor 14, 16 off line from some remote location in the event of failure.

A CONFIG softkey is also shown in the screen 900 that allows a user to calculate a set of parameters for use with each of the sensors 14, 16 having an associated aspiration fan 72 and piping configuration. The user may also set threshold values to activate the High Flow and Low Flow indicators of the screen 900. Similarly, the user may define conditions for a Fault indicator and for Sensor, Filter and Aspirator indicators.

FIG. 9 depicts a reporting message 1006 delivered in accordance with illustrated embodiments of the invention. Shown in the message is the text message 34 (labeled 1002 in FIG. 9) and also the destination Internet address 36 (labeled 1004 in FIG. 9).

In another illustrated embodiment, the detector 14, 16 may also include a statistical and fault (SP) processor 29 that collects statistical and fault information from the detector 14, 16. As above, the SP processor 29 may compare fault and statistical parameters with a set of threshold values and forward a report when such values exceed the corresponding threshold values. For example, the statistical processor 29 may collect an average deviation associated with an output of the sensor 26 from a norm. Similarly, the SP processor 29 may compare an output of the sensor 26 with a set of allowable outputs and generate a fault message when that value exceeds a corresponding threshold.

The system 10 allows for a much greater degree of flexibility than has otherwise been available in tracking operation of sensors 14, 16. For example, a user may define an Alert threshold level at a very low level to alert maintenance workers to low levels of contaminants in an atmosphere of the protected area 12. Similarly, the Action 1 and Action 2 levels may be defined to take other appropriate actions such as routing a notifying e-mail to an automatic controller that closes doors or evacuates areas based upon a set of thresholds selected by a user. Different Fire 1 and Fire 2 levels may be used to direct first responders to hot spots and to provide data for developing a strategy for addressing developing emergencies.

The system 10 may include one of a fire sensor, a carbon monoxide sensor, an ionization sensor, a particulate sensor, a gas leak detector and an aspirating sensor.

The system 10 may include an electronic data server wherein the electronic data server controls data access according to client-provided credentials. The electronic data server may further include a webpage that displays operating parameters and that updates the displayed values dynamically in real-time. The electronic data server may further include a webpage that provides a method of modifying detector parameters.

The system 10 may include a notification interface that transmits real-time status information on demand or periodically to a user terminal via the Internet protocol network interface.

A specific embodiment of method and apparatus for alerting in the event of developing environmental conditions has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An alarm system comprising:

one or more environmental condition detectors located within a secured area of the alarm system; and a wired or wireless network within the secured area that directly interconnects the one or more environmental condition detectors with a local alarm panel of the alarm system, the local alarm panel monitoring the one or more environmental condition detectors for indication of fire, wherein each of the one or more environmental condition detectors further comprises:

a detector element that measures a value of a predetermined environmental parameter;

an auxiliary reporting system that reports a status of measured values of the corresponding environmental condition detector independent of the monitoring associated with the local alarm panel;

a plurality of report message files included within the auxiliary reporting system, each of the plurality of report message files being associated with a predetermined person and including a text message, an Internet address of the predetermined person and a threshold value;

a processor that compares the measured value of the parameter with a respective threshold value of each of the plurality of report message files, detects that the measured value of the parameter exceeds one of the respective threshold values and constructs a message to the predetermined person associated with the one of the report message files with the exceeded threshold value; and an Internet protocol network interface that forwards the constructed message to the predetermined person.

2. The alarm system as in claim 1 wherein the one or more environmental condition detectors further comprises an aspirating sensor including an aspirating fan, associated piping and one of a fire sensor, a carbon monoxide sensor, an ionization sensor, a particulate sensor, a gas leak detector.

3. The alarm system as in claim 1 wherein the message further comprises one of an e-mail, an instant chat message and an Internet blog post or status update to the Internet blog post.

4. The alarm system as in claim 1 wherein the processor determines that operational integrity of the corresponding environmental condition detector has been compromised resulting in an error, constructs a message associated with the error and sends the message to a predetermined destination Internet address.

5. The alarm system as in claim 1 wherein the processor calculates operating statistics of the corresponding environmental condition detector, constructs a message consisting of the operating statistics, and sends the message to a predetermined destination Internet address.

6. The alarm system as in claim 1 wherein the Internet protocol network interface further comprises a serial or parallel interface.

7. The alarm system as in claim 1 wherein the Internet protocol network interface further comprises a wireless network interface.

8. The alarm system as in claim 1 further comprising an electronic data server.

9. The alarm system as in claim 8 wherein the electronic data server controls data access to the plurality of report message files according to client provided credentials from a user.

10. The alarm system as in claim 8 wherein the electronic data server further comprises a webpage that displays measured values of the corresponding environmental parameters of the one or more environmental condition detectors and that updates the displayed values dynamically in real-time.

11. The alarm system as in claim 8 wherein the electronic data server further comprises a webpage that provides a method of modifying at least the respective threshold values of the plurality of report message files.

12. The alarm system in claim 1 further comprising a network interface that receives configuration parameters of the corresponding environmental condition detector from a user terminal via the Internet protocol network interface.

13. The alarm system as in claim 1 further comprising a notification interface that transmits real-time status information regarding at least fault information of the corresponding environmental condition detector on demand or periodically to a user terminal via the Internet protocol network interface.

14. An alarm system comprising:

a plurality of environmental condition detectors of the alarm system; and a local alarm panel of the alarm system that monitors the plurality of environmental condition detectors for indication of a fire, wherein each of the plurality of environmental condition detectors further comprises:

a sensor element that measures a value of a predetermined environmental parameter;

an auxiliary reporting system that reports a status of measured values of the corresponding environmental condition detector independent of the monitoring associated with the local alarm panel;

a plurality of report message files included within the auxiliary reporting system, each of the plurality of report message files being associated with a predetermined person and including a text message, an Internet address of the predetermined person and a threshold value; and a processor that compares the measured parameter value with a respective threshold value of each of the plurality of report message files, determines that the measured environmental value of the parameter exceeds the threshold value of one of the plurality of report message files, constructs a message incorporating the text message and Internet address associated with the one of the plurality of report message files and sends the constructed message to the Internet address of the person associated with the one of the plurality of report message files.

15. The alarm system as in claim 14 wherein the text message further comprises one of an e-mail and a chat message.

16. The alarm system as in claim 14 wherein the threshold values of the plurality of report message files further comprises an alert threshold value having a lowest relative threshold value of the plurality of report message files.

17. The alarm system of claim 16 wherein the threshold values of the plurality of report message files further comprises an action threshold value having a greater relative value than the alert threshold value.

18. The alarm system of claim 17 wherein the threshold values of the plurality of report message files further comprises an alarm threshold value having a greater relative value than the alert and action threshold values.

19. An alarm system comprising:

an environmental detector that reports an alarm to a local alarm panel of the alarm system, wherein the environmental detector further comprises:

a sensor element that measures a value of a predetermined environmental parameter;

an auxiliary reporting system that reports a status of measured values of the environmental detector independent of the reported alarm associated with the local alarm panel;

a plurality of report message files included within the auxiliary reporting system, each of the plurality of report messages files being associated with a predetermined person and including a text message, a respective threshold value and a destination Internet address of the predetermined person associated with the report message file; and a processor that compares the measured value of the parameter with the respective threshold value of each of the plurality of report message files, detects that the measured value of the environmental parameter exceeds the respective threshold value of one of the plurality of report message files, incorporates the text message and destination Internet address from the one of the plurality of report message files into a user message and sends the user message to the destination Internet address of the person associated with the one of the plurality of report message files.

* * * * *